US005997286A

United States Patent [19]

Hemsath et al.

[11] Patent Number: 5,997,286

[45] Date of Patent: Dec. 7, 1999

[54] THERMAL TREATING APPARATUS AND PROCESS

[75] Inventors: Klaus Heinrich Hemsath, Toledo, Ohio; Arvind Chhotalal Thekdi, Rockford, Ill.; Rodney G. Whitbeck, Northville, Mich.; Mark George Shapona, Canton, Mich.; Ronald Scott Lucas, Livonia, Mich.; Claude Melvin Mack, Ypsilanti, Mich.

[73] Assignees: Ford Motor Company, Dearborn, Mich.; Indugas, Inc., Toledo, Ohio

[21] Appl. No.: 08/927,508

[22] Filed: Sep. 11, 1997

[51] Int. Cl.[6] ..... F27B 9/28

[52] U.S. Cl. ..... 432/59; 432/72; 432/152; 432/143; 432/176; 432/8

[58] Field of Search ..... 432/72, 95, 143, 432/144, 145, 152, 176, 121, 8

[56] References Cited

U.S. PATENT DOCUMENTS

| | | |
|---|---|---|
| 1,949,716 | 3/1934 | Harsch . |
| 2,367,732 | 1/1945 | Mueller . |
| 2,747,855 | 5/1956 | Ipsen . |
| 2,777,683 | 1/1957 | Ferguson . |
| 2,842,352 | 7/1958 | Tauber . |
| 2,978,237 | 4/1961 | Frank . |
| 3,191,919 | 6/1965 | Acker . |
| 3,219,330 | 11/1965 | Acker . |
| 3,484,085 | 12/1969 | Montagino . |
| 3,598,381 | 8/1971 | Schwalm et al. . |
| 3,662,996 | 5/1972 | Schwalm et al. . |
| 3,718,324 | 2/1973 | Westeren et al. . |
| 3,802,832 | 4/1974 | Nicolaus . |
| 3,950,192 | 4/1976 | Golland et al. . |
| 3,971,875 | 7/1976 | Regalbuto . |
| 4,218,214 | 8/1980 | Nelson . |
| 4,219,324 | 8/1980 | Zahniser . |
| 4,245,818 | 1/1981 | Elhaus et al. . |
| 4,310,300 | 1/1982 | Mackenzie . |
| 4,472,887 | 9/1984 | Avedian et al. . |
| 4,582,301 | 4/1986 | Wünning . |
| 4,622,006 | 11/1986 | Höhne . |
| 4,627,814 | 12/1986 | Hattori et al. . |
| 4,664,359 | 5/1987 | Hertwich . |
| 4,689,008 | 8/1987 | Hailey . |
| 4,744,750 | 5/1988 | Lingl, Jr. . |
| 4,751,886 | 6/1988 | Koptis et al. . |
| 4,767,320 | 8/1988 | Sasaki et al. . |
| 4,802,844 | 2/1989 | Kuhn et al. . |
| 4,807,853 | 2/1989 | Murakami et al. . |
| 4,857,689 | 8/1989 | Lee . |
| 4,932,864 | 6/1990 | Miyabe . |
| 5,002,009 | 3/1991 | Hayami et al. . |
| 5,127,827 | 7/1992 | Hoetzl et al. . |
| 5,143,558 | 9/1992 | Smith . |
| 5,164,145 | 11/1992 | Smith . |

*Primary Examiner*—Philip H. Leung
*Assistant Examiner*—Jiping Lu
*Attorney, Agent, or Firm*—Pauley Petersen Kinne & Fejer

[57] ABSTRACT

A thermal treating apparatus and process providing convection thermal transfer for elevated processing temperatures and chemical treatment. A recirculation plenum for passage of spent treatment fluid from and fresh treatment fluid to a treatment chamber may contain a thermal control source, a chemical control source, and a blower to provide predetermined programmable temperatures and chemical environments to articles in the treatment chamber. Decreasing cross sectional areas along the length of the treatment chamber cause introduction of fresh treatment fluid at different locations along the length of the treatment chamber to achieve desired uniform thermal and chemical treatment of articles along the length of the treatment chamber.

21 Claims, 12 Drawing Sheets

THERMAL TREATING APPARATUS AND PROCESS

BACKGROUND OF THE INVENTION

1. Field of the Invention

This invention relates to an apparatus and process for thermal treating using convection thermal transfer for elevated processing temperatures and may provide controlled chemical atmosphere for chemical treatment, such as carburizing. An elongated treatment chamber has a decreasing cross sectional area along its length, thereby providing introduction of treatment fluid at different locations to achieve desired uniform thermal and chemical treatment of articles along the length of a treatment chamber. A recirculation plenum, for passage of treatment fluid to and from a treatment chamber, contains a thermal control source and blower and may contain a chemical control source to provide predetermined programmable temperatures and chemical environments, such as oxidizing, reducing, neutral or other desired chemical environment, to treatment fluid for passage to a treatment chamber to effect desired thermal treatment and chemical surface reactions to articles passed through the treatment chamber. The uniform flow of treatment fluid obtained by this invention provides even temperatures and uniform chemical treatment of articles along the length of a treatment chamber reducing, or eliminating, uneven chemical treatment and thermal distortion of articles being treated. This invention is particularly applicable to thermal treatment and combined thermal and chemical treatment of metal articles, such as carburizing.

2. Description of Related Art

Heating metal articles, for example, for heat treating with heat sources and fans in a treatment chamber is well known. U.S. Pat. No. 1,949,716 teaches heat treating metal objects in a furnace having electric heating elements along side walls of a treatment chamber and a plurality of fans above and/or below the objects being treated. U.S. Pat. No. 4,767,320 teaches a continuous heat treating furnace compartmented into preheating, treating and cooling zones with the preheating and cooling zones divided into a plurality of compartments with controlled recirculation of gases from specific cooling zones to specific preheating zones for heat recuperation. All zones of the furnace have convection fans and the treating zone has a plurality of direct fired burners.

Heating metal articles for heat treatment wherein fans and heat sources are separated from the treatment chamber is exemplified by the teachings of the following patents. U.S. Pat. No. 5,127,827 teaches a horizontal cylindrical furnace having one closed end and an access door at the opposite end. Spaced inwardly from the closed end is a fan plate separating a heat treating chamber from a fan chamber, the fan plate having a central opening for recirculation of gases from the treating chamber to the fan chamber and a peripheral annular opening for circulation of gases from the fan chamber along the periphery of the treating chamber to the opposite end and return passage across parts being treated in the central portion of the treating chamber to the central opening in the fan plate. In one embodiment, heating elements extend in the periphery the length of the fan chamber and the treating chamber, which additionally is provided with heat sinks, and in another embodiment a peripheral incineration burner with an incineration combustion zone extends around the periphery of the fan chamber and a peripheral gas fired heating burner is fired into the fan chamber, both burners providing heat to gases in the fan chamber for circulation to the treating chamber. The atmosphere in the treating chamber may be controlled by the combustion conditions of the heating burner. U.S. Pat. No. 4,751,886 teaches a control system for ramping temperature in the main chamber of a batch pyrolysis furnace and duration of subsequent soak by a single thermocouple in the throat of the furnace controlling water spray to the main chamber. The furnace is heated by hot combustion gases from a separated main burner in combination with an afterburner. U.S. Pat. No. 4,664,359 teaches a vertical furnace wherein alloy ingots are conveyed through a plurality of partitioned vertical heating shafts which are heated by circulation of gases driven by a fan in a separate vertical plenum in heat exchange relation with an electric heater or flames from combustion burners. U.S. Pat. No. 4,219,324 teaches heat treating metals in a horizontal furnace in which radiant tube firing at a low pressure is the source of heat as well as the source of desired atmosphere composition for the heat treatment. The treatment chamber is in indirect thermal exchange relation with radiant tube heaters from which the combustion product gas is externally treated and passed to the treatment chamber as a treatment atmosphere. One disadvantage of this system is that the combustion product gas is cooled in the external treatment system.

Heat treatment systems having a plurality of temperature and/or controlled atmosphere zones are known for a wide variety of applications. Heat treatment of metal parts is taught by U.S. Pat. No. 4,932,864 wherein a roller hearth heat treating furnace has three separated independently temperature controlled treating chambers, the first chamber having radiant tubes and fans, the second having radiant tubes, a cooler and fans, and the third having electro tubes, cooling tubes, and fans. U.S. Pat. No. 4,857,689 teaches heat treating of semiconductor wafers in a tubular furnace having indirect heating at a closed end and injection of cooling gas at the opposite end wherein very rapid programmable heating and cooling is obtained by movement of the semiconductor wafers along the axis of the furnace in response to temperature sensors. U.S. Pat. No. 4,218,214 teaches a furnace paddle for holding semiconductor wafers for movement through a cylindrically-shaped processing furnace. U.S. Pat. No. 4,744,750 teaches a tunnel kiln having a heat-up zone, firing zone, and cooling zone wherein kiln cars having a solid bottom extending close to the side walls forms an undercar cooling channel in the cooling zone and downstream end of the firing zone. The cooling zone is cooled by fans recycling air over heat exchangers providing convection cooling of the material being treated. U.S. Pat. No. 4,310,300 teaches a porcelain enameling furnace system having a drying zone, preheat zone, heating zone, and cooling zone wherein the heating zone is heated by a serpentine tube radiant heater with combustion gases passing from the radiant heater in indirect heat exchange in the preheat zone and then passing in direct heat exchange with the articles being treated in the drying zone. U.S. Pat. No. 3,802,832 teaches a heating chamber formed from a number of sub-chambers which are releasably connected to modify the capacity of the heating chamber for heat treatment of food. The chamber is heated by internal heaters with air circulated by fans.

Hot pressing of metal powder is taught by U.S. Pat. No. 4,689,008 wherein a system for rapid heating of metal powder for consolidation has a plurality of zones of controlled temperature and atmosphere wherein the powder is preheated, heated by hot cavity walls, packed, and consolidated by pressing. U.S. Pat. No. 3,971,875 teaches vacuum hot pressing of materials wherein an external press acts upon rigid walls of the furnace chamber with movable sidewalls to provide application of the press force upon the material in the chamber.

U.S. Pat. No. 4,472,887 teaches a series of separated chambers individually heat and moisture controlled for dehydrating produce, each chamber having a separate plenum in which a fan recirculates air past the flame of a gas combustion burner for heating and reintroduction to one end of the treatment chamber.

Roller conveyors are known for transporting articles in heat treating furnaces. U.S. Pat. No. 5,002,009 teaches a tunnel furnace having a roller conveyor with independently controlled drive systems in separate chambers of the furnace for conveying containers through the furnace in adjacent fashion. U.S. Pat. No. 4,807,853 teaches a continuous furnace for gas carburizing and hardening having a plurality of groups of roller conveyor drive systems for conveying articles at different speeds through different portions of the furnace. U.S. Pat. No. 2,978,237 teaches a heat treating furnace having continuously operating conveying rollers for transport of articles and means for lifting the articles from the conveying rollers for desired periods of treatment. U.S. Pat. No. 4,802,844 teaches a retractable roller hearth to take the load off rollers during most of the heat cycle in a batch heat treating furnace having a radiant tube within the treating zone to prevent commingling of combustion gases and furnace atmosphere.

Pusher mechanisms are known to be used for transport of trays of parts in heat treating furnaces. U.S. Pat. No. 5,143,558 teaches an integrated continuous/batch furnace system wherein trays of parts are individually loaded and pushed adjacently in the continuous furnace system and are connected together with clips and delivered to the batch furnace system. The continuous furnace system uses a rotary carburizing furnace. U.S. Pat. No. 4,582,301 teaches heat recovery in a heat treatment furnace system wherein baskets of articles are pushed by pistons through the furnace system. Heat transfer gas is constrained to flow vertically through the baskets and the ends of the baskets fit gastight in abutment with the end of adjacent baskets. U.S. Pat. Nos. 3,662,996 and 3,598,381 teach carburizing furnace systems wherein trays of materials to be treated are pushed on rails through the system by a number of motor driven pushers.

U.S. Pat. No. 2,842,352 teaches transport of a tray of work in a batch heat treating furnace by a reciprocating rod having hook(s) for engagement of and disengagement from the tray by rotation of the rod 90°, the reciprocating rod pulling the tray into position in the furnace on rails. A plurality of hooks may be used for engagement at opposite ends of the tray and for shortening the stroke of the reciprocating rod which is driven by a mechanism exterior to the furnace.

U.S. Pat. No. 4,245,818 teaches transfer devices providing independent speeds through pretreatment and heat treatment furnaces. The pretreatment furnace uses rapid hot gas impingement heating and the holding furnace uses forced hot gas circulation. The articles are rolled across sawtoothed shaped depressions on the transfer devices.

Transfer of materials directly from transport through a heat treatment furnace to a lower quench bath is taught by several U.S. Pat. Nos. 2,747,855 teaches transport of articles from a heat treatment furnace by an elevator to a quenching zone while being maintained in a controlled atmosphere common to the treatment furnace and the quenching zone; 3,191,919 teaches a chain driven transfer mechanism moving articles through a heat treatment furnace and onto an elevator for lowering into a quench tank; and 3,718,324 teaches a work cart which moves through a vacuum heat treatment furnace to an elevator for lowering into a quench chamber, the heating zone, transfer zone, and quench zone being open to each other. U.S. Pat. No. 2,367,732 teaches a work holder for vertical reciprocation in a liquid treatment tank.

It is known to separate a heat treating zone from a quenching zone as taught by the following U.S. Pat. Nos. 3,484,085 teaches an elevator to transport material from a heat treatment furnace to a quench chamber directly below the heat treatment furnace and separated by a retractable door, with the material support means used in the heat treatment furnace not being transferred to the quench chamber; 3,219,330 teaches a reciprocating pusher rod insertable through the furnace door moving material through and from a sealed heat treating furnace through discharge doors to an elevator for lowering into a quench bath; and 2,777,683 teaches introducing material into a vestibule and pushing the material from the vestibule into an electrically heated heat treatment furnace and use of chain driven roller means for conveying material through a controlled atmosphere vestibule chamber to an elevator for lowering into a cooling treatment tank with the openings in the bottom of the vestibule for the elevator being sealed from outside environment by casings extending into the cooling liquid.

U.S. Pat. No. 3,950,192 teaches carburizing of a continuous strip in a heat treating furnace providing high carbon availability followed by homogenizing and quenching by impinging gas jets. Carburizing systems having multiple zones is taught by U.S. Pat. No. 4,622,006 for heat treating metallic articles, especially two-stage carburization, in a furnace having a plurality of treatment chambers in which the articles are irregularly conveyed in at least one of the chambers resulting in varying retention times in the chambers, such as joined rotary-cycle furnaces having selectively rotatable hearths. The cycle for carburization includes a preheating chamber, carburization chamber, diffusion chamber, cooling chamber, and quenching chamber. U.S. Pat. No. 5,164,145 teaches a rotary carburizing furnace having an annular fluid seal in the annular slot between the hearth and the sidewall. Internal radiant tubes provide heat which is distributed by fans and atmospheric inlet ports to the furnace chamber with gas ports delivering purge gas to annular slot. The carburizing system includes a separated preheat furnace, rotary carburizing furnace, rotary diffusion furnace, and rotary equalizing furnace. U.S. Pat. No. 4,627,814 teaches a carburizing continuous heat treating furnace for metal parts which is separated into a charging chamber, heating chamber, treating chamber, and cooling chamber, each chamber having thermal transfer means and fans within the chamber. The charging chamber is fed air and combustible gas to create desired oxidizing atmosphere for deoiling and the other chambers are provided with a gas generator for endothermic gas to create neutral and reducing atmospheres.

SUMMARY OF THE INVENTION

It is an object of this invention to provide a thermal treating apparatus and process having controlled convection thermal transfer between a uniform flow of treatment fluid and articles being treated, thereby providing even heating and reducing or eliminating thermal distortion of articles treated.

It is another object of this invention to provide a thermal treating apparatus and process which additionally provides controlled uniform chemical treatment of articles being treated.

Another object of this invention is to provide a thermal treatment apparatus having the thermal control mechanism and the blower exterior to a treatment chamber enabling repair and replacement of the thermal control mechanism and the blower without requiring entry of the treatment chamber.

It is yet another object of this invention to provide a thermal treating apparatus and process system providing different controlled thermal and chemical treatments of articles along a continuous flow of articles being treated.

It is yet another object of this invention to provide a thermal treatment apparatus and process in which a single blower in a recirculation chamber achieves uniform flow of treatment fluid about an entire load of articles in a treatment chamber.

Another object of this invention is to provide a thermal treatment apparatus and process in which pre-programmed thermal treatment and chemical treatment may be provided uniformly to articles in a treatment chamber.

These and other objects and advantages, which will become apparent upon reading of the following description, are achieved by convection thermal transfer, for heating or cooling articles, between a uniform flow of treatment fluid and articles being treated in an elongated treatment chamber having a decreasing cross sectional area along its length. Articles being treated are passed through the treatment chamber from a treatment upstream end portion to a treatment downstream end portion. A recirculation plenum is located exterior to the treatment chamber, the recirculation plenum having an entry, or recirculation plenum upstream end portion, in fluid communication with the downstream end portion of the treatment chamber and an exit, or recirculation plenum downstream end portion, in fluid communication with the treatment chamber through a fluid distribution system causing delivery of treatment fluid at a plurality of locations along at least a portion of the length of the treatment chamber. A blower is located in the recirculation plenum to pass recirculation fluid through the recirculation plenum to condition it as treatment fluid and to pass treatment fluid through the treatment chamber. Thermal control mechanisms to add or extract thermal energy to change the recirculation fluid to a desired thermal state for treatment fluid are also located in the recirculation plenum. The fluid distribution system causing delivery of treatment fluid at a plurality of locations along at least a portion of the length of the treatment chamber is the decrease of the cross sectional area of the treatment chamber along at least a portion of its length. The decrease in cross sectional area of the treatment chamber may be effected by a converging of the sides or top and bottom of the chamber or by fluid bypass channels of differing lengths and/or cross sectional areas in any one or more of the sides, top or bottom. Convection heating or cooling of articles being treated, according to this invention, obtains high uniformity of thermal treatment, thereby avoiding distortion of the articles due to transient or localized thermal conditions. Significant uneven radiant thermal transfer to the articles being treated is avoided according to this invention. The apparatus and process of this invention passes treatment fluid through the treatment chamber at rapid flow rates, about 1600 to about 2400 feet per minute, in the order of ten times gas flow rates used in prior heat treating furnaces.

In one embodiment of this invention, chemical control mechanisms may also be located in the recirculation chamber to add chemicals to obtain the desired chemical state for the treatment fluid, such as providing oxidizing, reducing or neutral environments. Introduction of the treatment stream at a plurality of locations from the treatment upstream end portion along at least a portion of the length of the treatment chamber, according to this invention, provides uniform chemical environment to articles at all locations in the treatment chamber.

Elimination of blowers, thermal control elements and chemical control means from the treatment chamber allows use of a smaller volume treatment chamber, for the same volume of articles being treated, resulting in greater efficiency and uniformity in thermal transfer to the articles being treated. Further, repair and replacement of these components may be readily achieved without entry to the treatment chamber.

In one embodiment of this invention, the fluid distribution system delivering fresh treatment fluid at a plurality of locations from the upstream end of the treatment chamber, along at least a portion of the length of the treatment chamber, comprises a sloping or stepped roof causing decreasing cross sectional area of the treatment chamber along its elongated axis from the treatment fluid upstream end. This treatment chamber configuration provides desired uniform temperature and chemical composition of treatment fluid contacting articles being treated regardless of their location in the treatment chamber.

In a different embodiment of this invention, the distribution system delivering fresh treatment fluid at a plurality of locations from the upstream end of the length of the treatment chamber, along at least a portion of the length of the treatment chamber, comprises at least one and usually a plurality of fluid bypass channels, or conduits, in at least one sidewall, top or bottom wall. The bypass conduits pass portions of the treatment fluid directly to downstream articles being treated, thereby providing treatment fluid of the same temperature and chemical composition to all articles being treated. The bypass conduits may have differing lengths and/or differing cross sectional areas to ensure desired uniform temperature and chemical composition of treatment fluid contacting articles being treated regardless of location in the treatment chamber.

In another embodiment of this invention, a pusher bar movable along the length of the treatment chamber has a plurality of lugs extending radially and spaced to be engageable with holding means for articles being treated upon rotation of the pusher bar to provide movement of the articles being treated through the thermal treating apparatus in spaced relation. This provides even fluid flow over the articles being treated and allows movement of any desired number of individual holding means through the thermal treating apparatus.

While predetermined differing temperatures and chemical conditions may be programmed and obtained in a single treatment chamber at different times according to this invention for batch type operation, a thermal/chemical treatment system according to this invention may comprise a plurality of thermal treating apparatus as described above arranged in series with thermal insulating doors between them to provide different thermal and/or chemical treatment conditions for continuous type operation. For example, a preheating zone may be maintained as an oxidizing atmosphere to deoil articles, a treating zone may be maintained under a carburizing atmosphere, and a conditioning zone may be maintained for controlled reduction of temperature of articles under controlled atmosphere prior to rapid transfer to a quenching zone.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
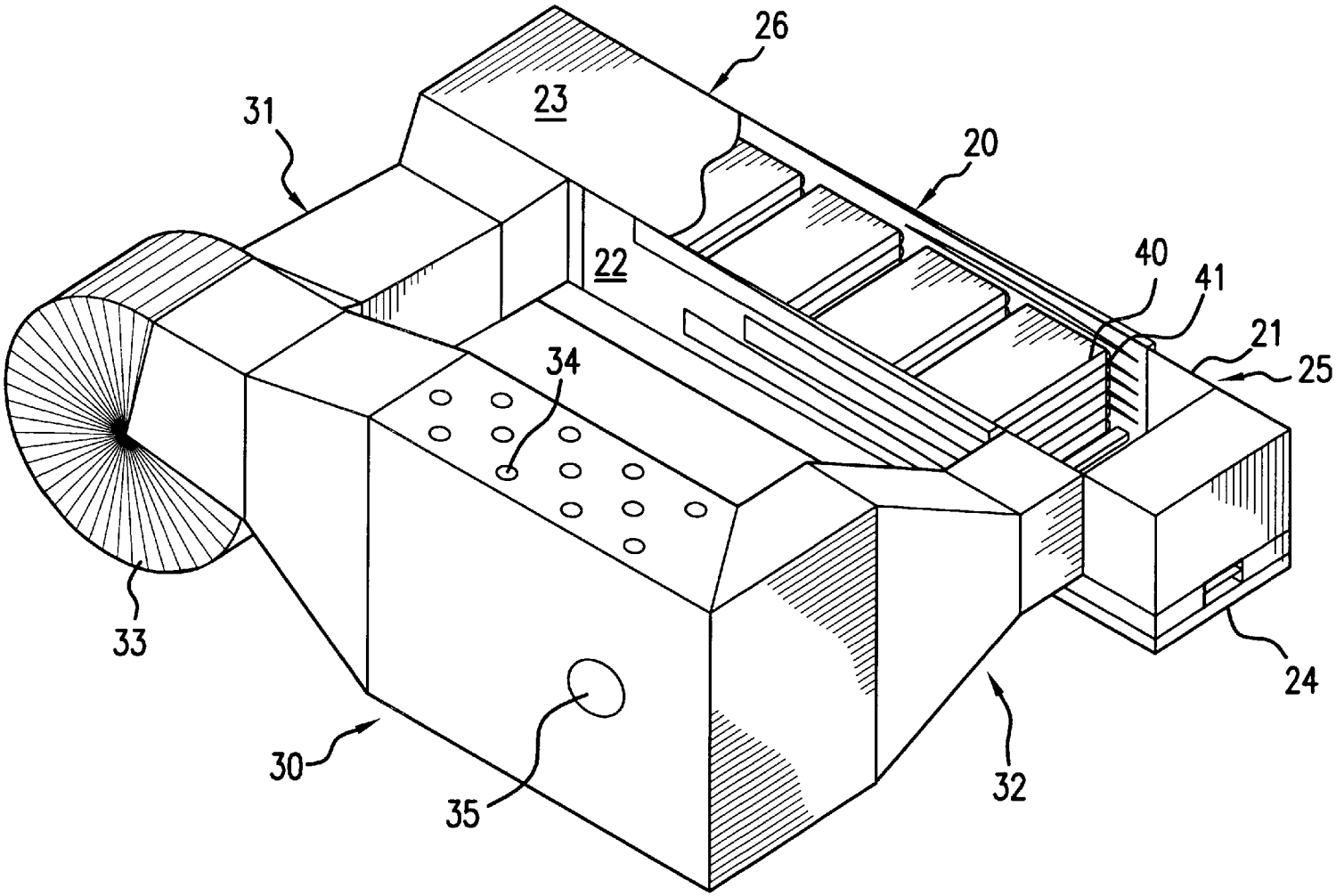
FIG. 1 is a partially cut-away perspective schematic view of a thermal treating apparatus according to one preferred embodiment of this invention.
Figure 2:
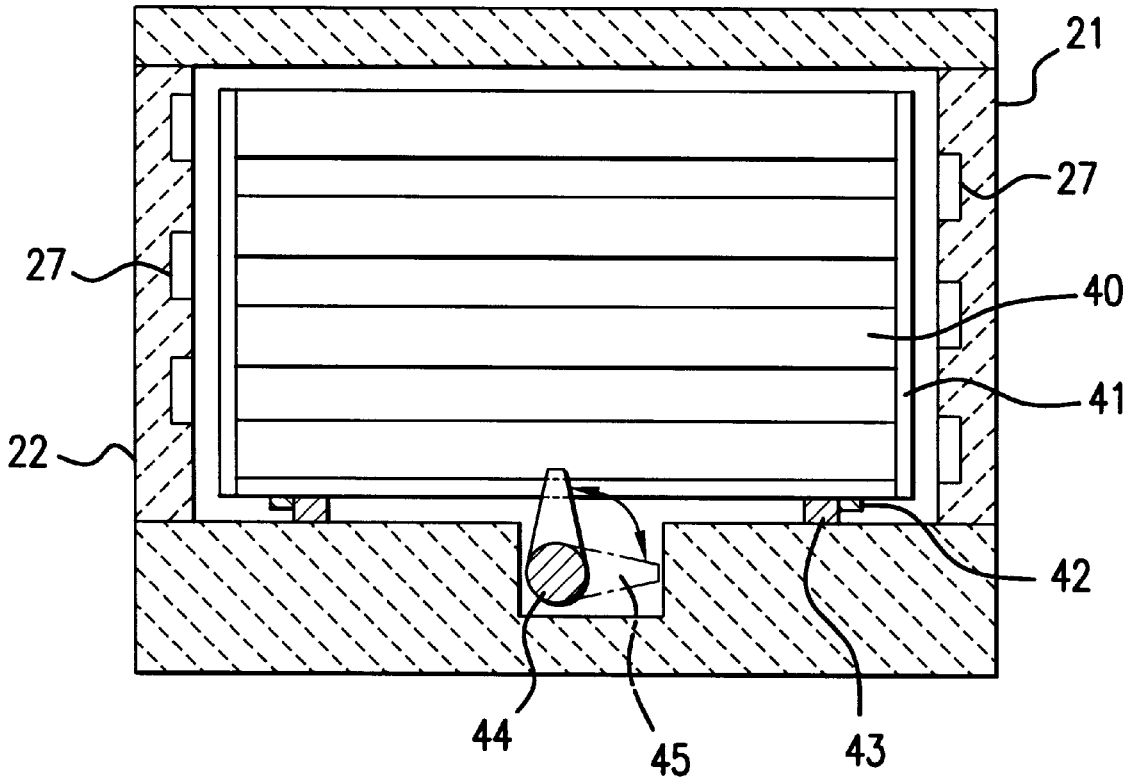
FIG. 2 is a cross-sectional view through the upstream stack of parts trays as shown in FIG. 1.

FIG. 1 is a partially cut-away perspective schematic view of a thermal treating apparatus according to one embodiment of this invention. Elongated treatment chamber 20 is enclosed by side walls 21 and 22, top 23 and bottom 24. Heat treating chambers are usually constructed of refractory materials, as well known in the art. Articles being treated are passed through treatment chamber 20, normally on tracks 43, as shown in FIG. 2, running the length of chamber 20. Smaller articles are normally spaced on trays 40 which have side and bottom openings to allow circulation of the treatment medium around each article being treated. A plurality of trays may be stacked in spaced relation on a holder 41 so that treatment medium may be readily circulated between the trays and thereby around each article being treated. The articles on holder 41 are moved through treatment chamber 20 on tracks 43 aided by guides 42 on holder 41. Any suitable means of passing articles to be treated through treatment chamber 20 may be used. Articles to be treated are introduced into elongated treatment chamber 20 at treatment upstream end portion 25 and treated articles exit treatment chamber 20 at treatment downstream end portion 26.

An important feature of this invention is recirculation plenum 30 having a recirculation plenum upstream end portion 31 in fluid communication with the treatment downstream end portion 26 of treatment chamber 20 and a recirculation plenum downstream end portion 32 in fluid communication with the treatment upstream end portion 25 of treatment chamber 20. Blower 33 is located within and/or attached to recirculation plenum 30 to pass treatment fluid through treatment chamber 20 and recirculation fluid through recirculation plenum 30. Any suitable blower known to the art for passing the desired velocity and quantity of treatment fluid may be used.

Figure 12:
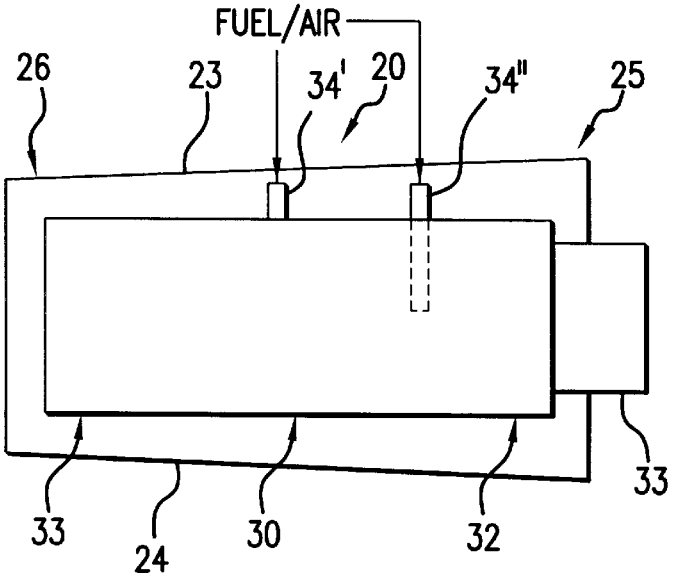
FIG. 12 is a schematic diagram of a side view of a thermal treating system in accordance with one embodiment of this invention having converging top and bottom walls.

Recirculation plenum 30 also contains means to convert spent treatment fluid, or recirculation fluid, which enters recirculation plenum through recirculation plenum upstream end portion 31, to the desired thermal and chemical state for treatment fluid and reentry to treatment chamber 20 and passage in contact with articles to be treated. Thermal control mechanisms 34 are located within and/or attached to recirculation plenum 30 to add or subtract thermal energy as desired to change the recirculation fluid to the desired thermal state for treatment fluid. For heating the recirculation fluid, any known heater may be used, such as, for example, electric heaters, radiant heater tubes, as shown in FIG. 12 open flame burners, 34' as shown in FIG. 12 or any other known heater. Likewise, for cooling the recirculation fluid, any known cooler may be used, such as, for example, chilled fluid heat exchangers, or any other known cooler. In this invention all of the thermal energy addition or subtraction to fluid for conversion of recirculation fluid to treatment fluid takes place in the recirculation plenum. Predetermined temperatures of the treatment fluid may be controlled by a sensor or sensors located in the recirculation plenum activating or deactivating thermal control mechanisms located in and/or attached to the recirculation plenum for supply or extraction of thermal energy. Thus, the complete thermal control system and the blower for passage of fluid through the thermal treating apparatus may be repaired or replaced on the exterior of and/or by entry into only the recirculation plenum without the requirement of entry into the treatment chamber, necessitating a complete shutdown, and disturbance of treatment chamber refractories.

Chemical control mechanism 35 is shown schematically as an injector for injection of any desired chemical into the flow of the recirculation fluid to change its state to the desired chemical state for treatment fluid. For example, oxygen or an oxygen containing gas may be introduced to obtain an oxidizing atmosphere, hydrogen or hydrogen containing gas may be introduced to maintain a reducing atmosphere, or a chemical may be introduced for desired chemical reaction with the surface of materials being treated, such as providing a carburizing atmosphere. The thermal control mechanism may also change the chemical composition of the recirculation fluid, such as an open flame burner with controlled fuel/air mixing for producing oxidizing or neutral environments. Predetermined chemical composition of the treatment fluid may be controlled by a sensor or sensors located in the recirculation plenum activating or deactivating chemical control means located in and/or attached to the recirculation plenum. Again, the complete chemical control system for control of the chemical composition of the treatment fluid may be repaired or replaced without entry into the treatment chamber.

Size and location of the blower, thermal control mechanism, chemical control mechanism and configuration of the recirculation plenum can readily be determined by one skilled in the art, depending upon the size and type of particular treatment system. The recirculation plenum may also contain any desired fluid mixing mechanism, as will be well known in the art, for mixing of the recirculation fluid to assure uniform temperature and uniform chemical composition of the treatment fluid passed to the treatment chamber.

Treatment fluid at the desired predetermined temperature and chemical composition is passed from the recirculation plenum downstream end portion to the treatment chamber through distribution means which deliver treatment fluid at a plurality of locations along at least a portion of the length of the treatment chamber. An important feature of this invention is that the treatment fluid is delivered at a plurality of locations along at least a portion of the length of the treatment chamber. This is achieved by the treatment chamber having a decreasing cross sectional area along its length from the end at which treatment fluid is introduced. In preferred embodiments, the decreasing cross sectional area of the treatment chamber is achieved by a sloping roof 23 as shown in FIG. 13 or by bypass channels in chamber walls to provide treatment fluid of desired uniform controlled temperature and chemical composition along the length of the treatment chamber.

Figure 11:
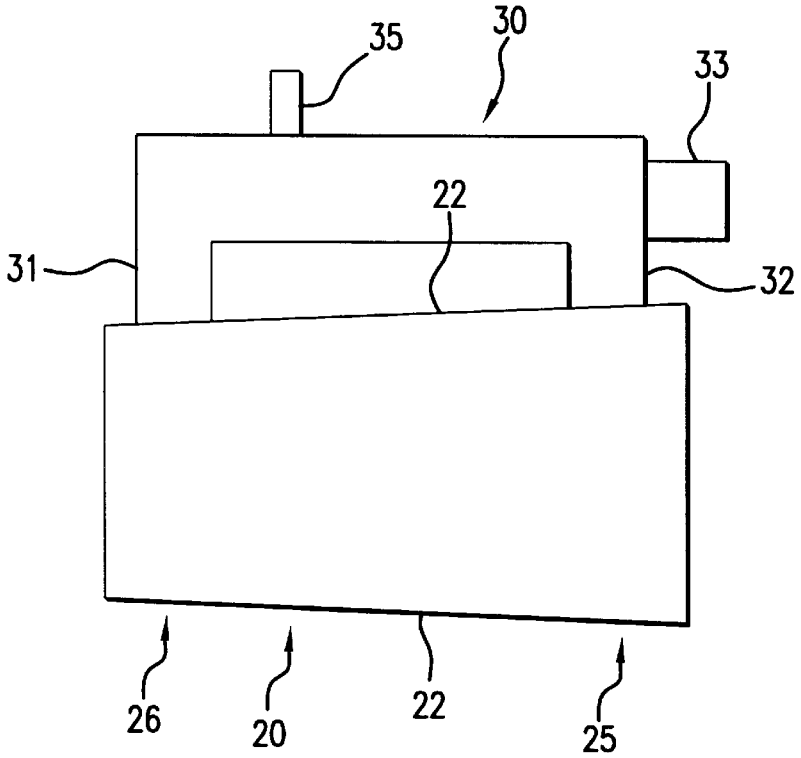
FIG. 11 is a schematic diagram of a top view of a thermal treating system in accordance with one embodiment of this invention having converging side walls.

In one embodiment, bypass channels may be located in the treatment chamber walls, top or bottom providing uniform fresh treatment fluid flow to articles being treated in an in-line relation in the treatment chamber. Thus, uniform convective thermal transfer and chemical treatment to articles being treated is achieved regardless of their location in the treatment chamber. The bypass channels may be of differing sizes and extend for differing lengths along the length of the treatment chamber. The bypass channels thereby serve as fixed valves which control the volume, velocity and direction of treatment fluid delivery to the articles being treated. This allows the article orientation to be "in-line" with minimum front-to-back process induced variations. The features of this invention provide high convection continuous carburizing furnaces, as well as high production batch furnaces, tempering furnaces, and other controlled chemical atmosphere processing thermal treatment apparatus. The bypass channels are used to deliver high temperature, high carbon atmosphere, in the case of carburizing, evenly to the load being processed. In another embodiment, the bypass function is accomplished by varying the clearance between the load and the treatment chamber roof and floor or sidewalls by a converging roof and floor or sidewalls as shown in FIGS. 11 and 12, thereby decreasing the chamber cross sectional area along the length of the chamber from the upstream end. The greater the bypass, the more treatment fluid is delivered to the downstream work in the load. Computational fluid dynamics (CFD) computer analysis of the furnace geometry and load can be used to determine the desired bypass needed to provide uniformity required by the process. Different components will benefit by more bypass than others to maintain the required temperature and treatment gas chemical composition. Bypass can also be provided along the process zone to deliver high energy and/or desired process atmosphere to specific locations in the load as shown by either process data or CFD analysis to be required.

FIG. 2 is a cross-sectional view through the upstream stack of parts trays shown in FIG. 1, showing bypass channels 27 in opposite side walls 21 and 22. As shown in FIG. 2, one preferred embodiment for arrangement of bypass channels 27 is that the bypass channels in one sidewall are in staggered vertical arrangement with respect to the bypass channels in the opposite sidewall. The bypass channels provide even flow of treatment fluid to all articles being treated and thereby result in uniform thermal transfer and chemical treatment of articles in the treatment chamber, regardless of their position in the treatment chamber.

Figure 3:
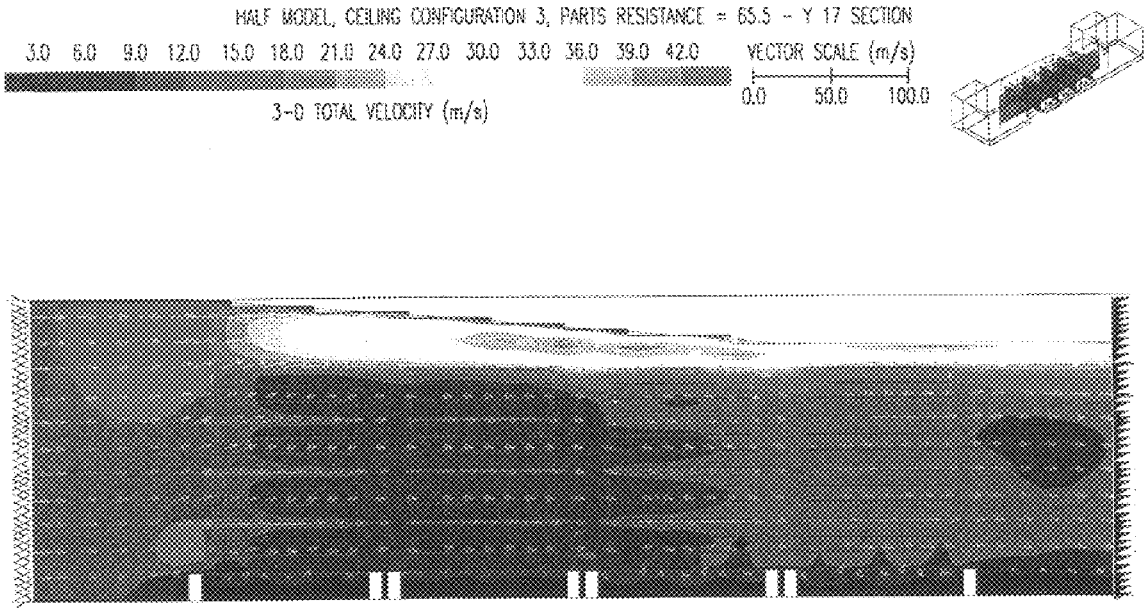
FIG. 3 shows results of a 3-D velocity study through a vertical cross-section of a treatment chamber having a stepped, or sloping, roof according to one embodiment of this invention.
Figure 13:
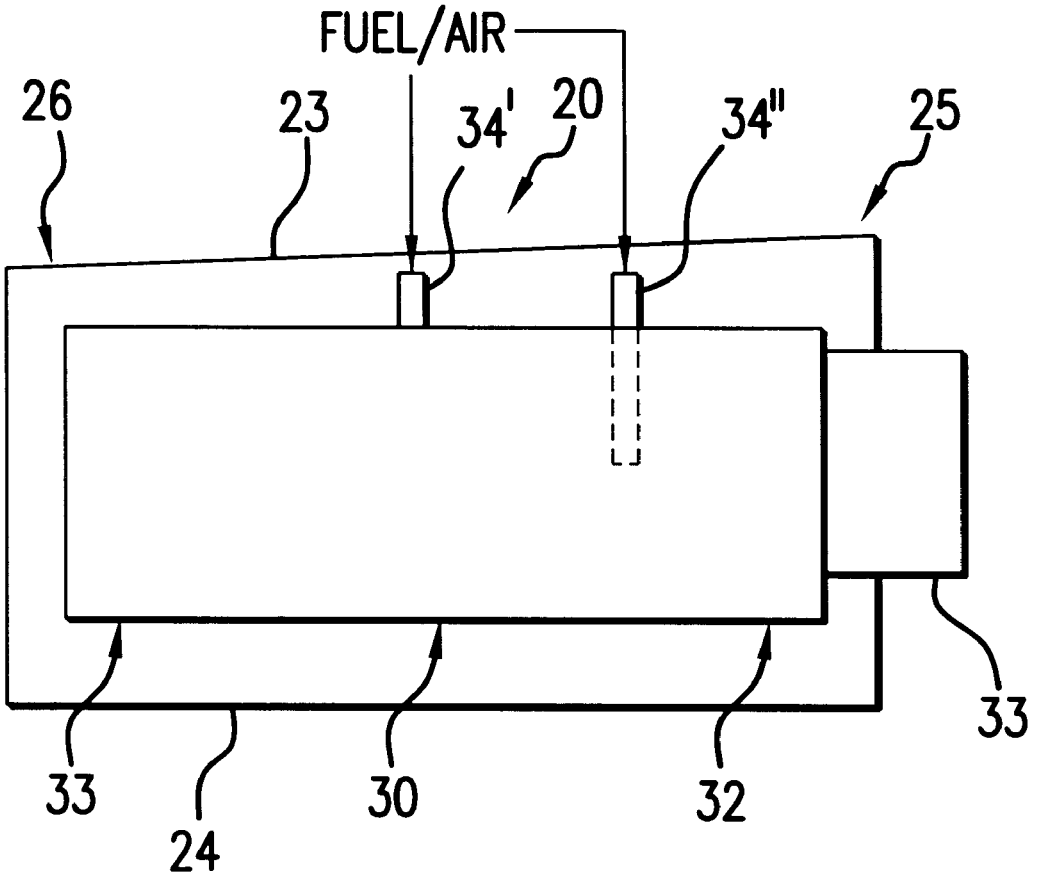
FIG. 13 is a schematic diagram of a side view of a thermal treating system in accordance with one embodiment of this invention having a sloping roof.

FIG. 3 shows results of a 3-D velocity study along a central vertical longitudinal section, as indicated, of a treatment chamber having decreasing cross section from its upstream end resulting from a stepped, or sloping, roof as shown in FIG. 13. The load was made up of four stacks of parts trays, or fixtures, in each of four holders as shown in the treatment chamber. The load had a clearance of 1 inch between the trays and the treatment chamber walls and floor. A 7500 CFM blower in the recirculation plenum provided flow of the recirculation and treatment fluid. The recirculation fluid was heated in the recirculation plenum by vertical single ended ceramic radiant tubes to provide the desired thermal energy change to suitable treatment fluid, as will be described in greater detail. FIG. 3 shows that the treatment fluid velocity at the downstream end of the load was slightly higher than at the upstream end of the load. This compensates for the higher temperature of the upstream treatment gas and serves to equalize temperature throughout the load. As seen in FIG. 3, the flow of treatment fluid is very uniform over the vertical cross section of a stack of trays.

Figure 4:
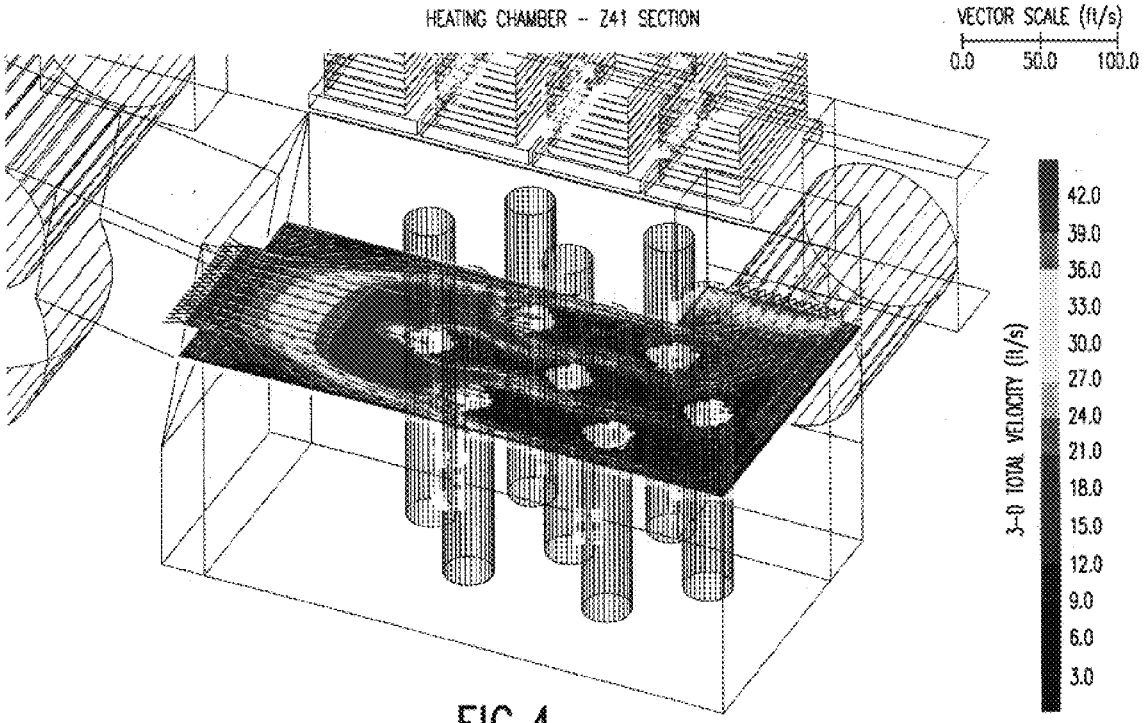
FIG. 4 shows results of a 3-D velocity study through a horizontal cross-section of a heating chamber as generally shown in FIG. 1.

The maximum flow and chamber pressure is determined by the performance characteristics of the high velocity fan in the recirculation chamber, the flow being restricted by the geometry and density of the load being processed in the treatment chamber and the heating elements immersed in the fluid flow in the recirculation chamber. FIG. 4 shows flow analysis results of a 3-D total velocity study through a horizontal cross-section taken through the heating section of the recirculation plenum showing flow velocities around heating elements and reentry of treatment fluid into the treatment chamber at a fairly constant velocity. A 7500 CFM blower in the recirculation plenum provided flow of the recirculation and treatment fluid.

Figure 5:
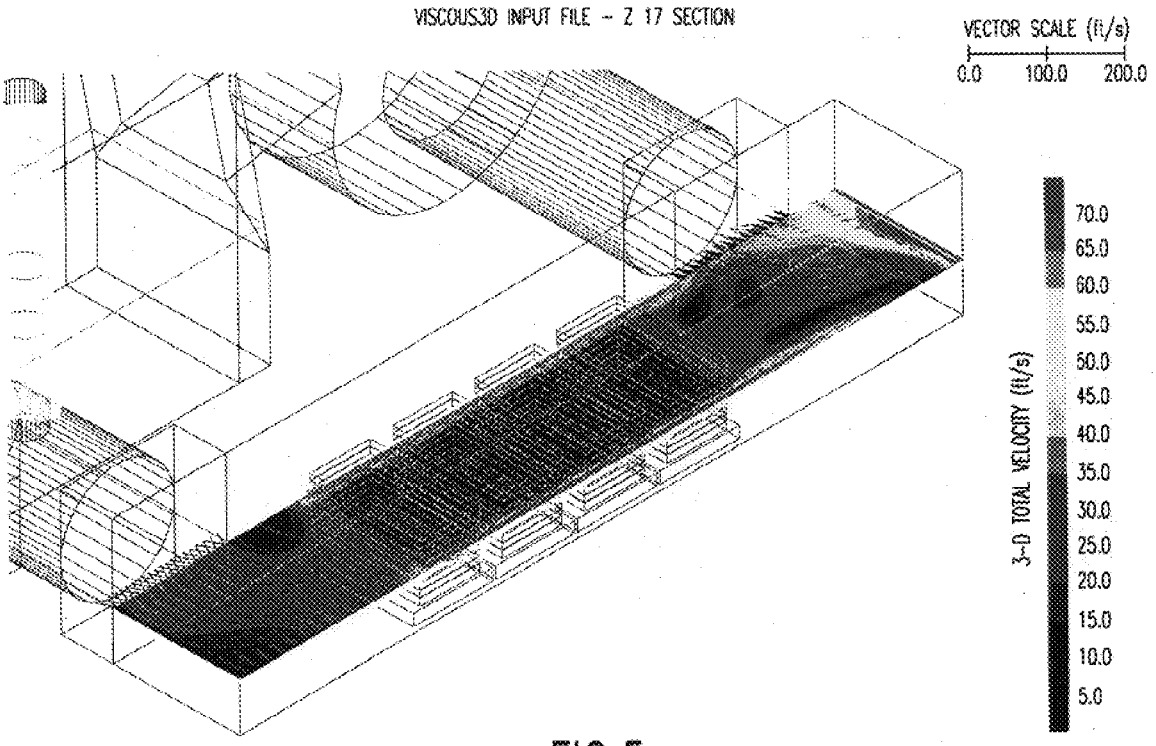
FIG. 5 shows results of a 3-D velocity study through a horizontal cross-section of the treatment chamber shown in FIG. 3.

FIG. 5 shows flow analysis results of a 3-D total velocity study through a horizontal cross-section taken through parts trays in the treatment chamber attached to the recirculation plenum shown in FIG. 4. Bypass of the treatment fluid was achieved by the sloping roof, as shown in FIG. 3. As shown in FIG. 5, 4 stacks of 4 parts fixtures each were located in the treatment chamber each having 1 inch clearance from each sidewall and bottom with 1 inch clearance between the fixtures holding parts being treated. The location of the stacks of parts in the treatment chamber and the part density determine flow resistance and influence the overall uniformity of flow over the parts. FIG. 5 shows the relatively uniform flow rate over the parts being treated.

Figure 6:
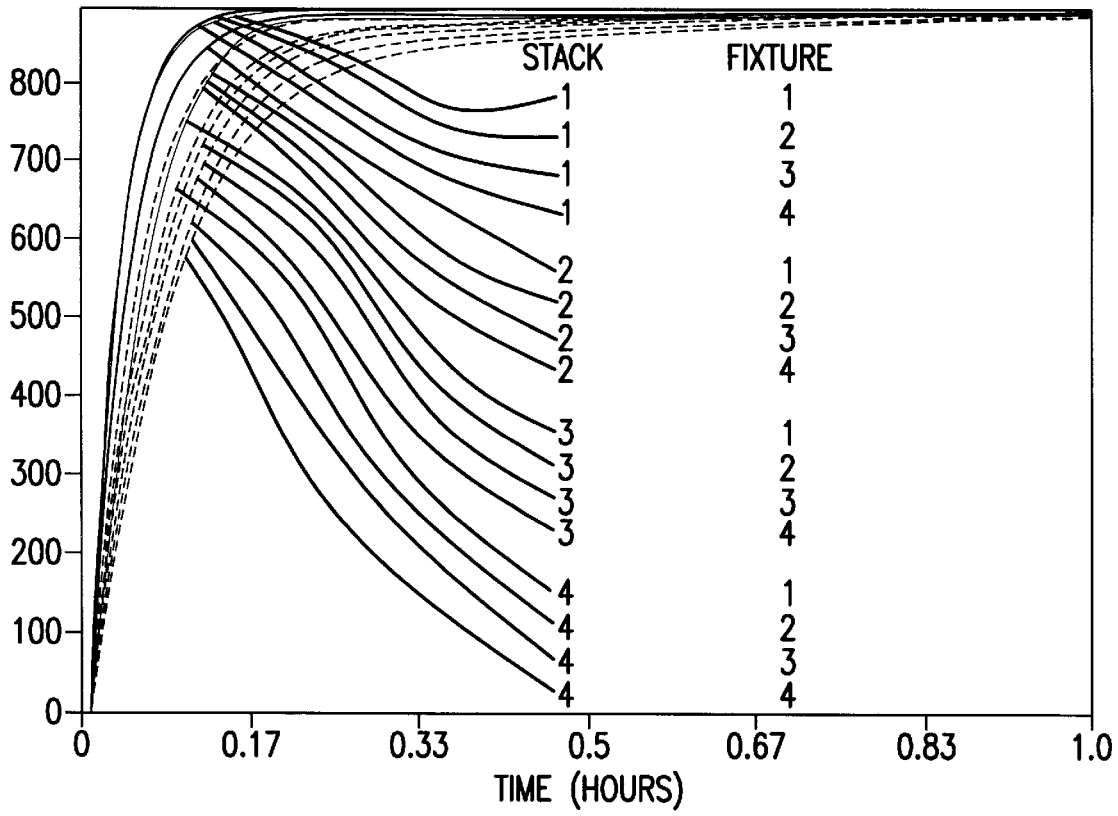
FIG. 6 shows part temperatures during 1 hour of heating at the locations shown by treatment fluid as shown in FIG. 6.
Figure 7:
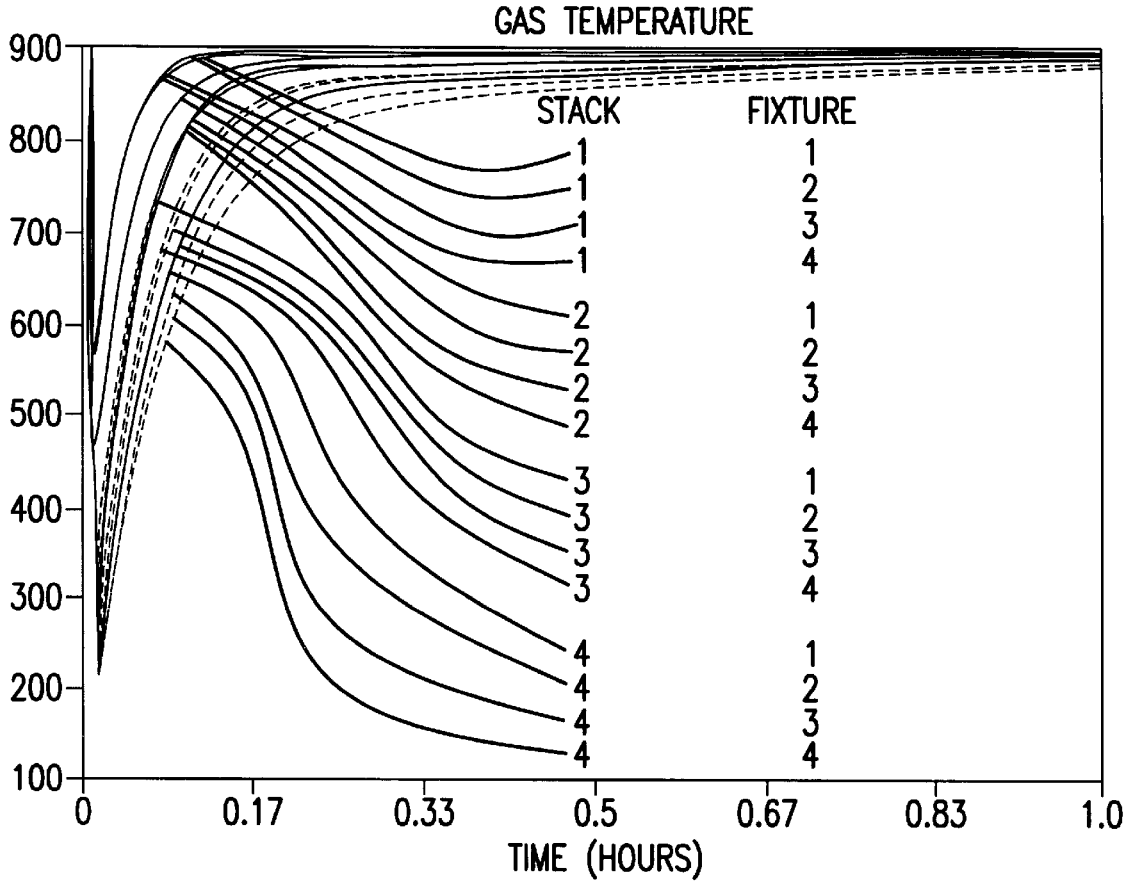
FIG. 7 shows treatment fluid temperatures during 1 hour of heat up at the locations indicated.

A similar analysis was completed for pressure loss through both the heating section and the treatment chamber to determine optimum element position for process uniformity. Based upon the flow and the pressure analysis, a thermal analysis shows practice of this invention results in a significant improvement in load heating time of less than 1 hour as compared with up to 2 hours with presently used continuous carburizing furnaces, and part temperature uniformity after 1 hour of ±3° C. as compared with presently obtained temperature uniformity of ±12° C. FIGS. 6 and 7 summarize the results of thermal analysis showing the part temperatures and the gas temperatures, respectively, during a one hour heat up at noted locations in the treatment chamber under conditions as noted with respect to FIGS. 3, 4 and 5 and with gear spacing at 0.0225 m, noted as recommended in FIG. 8. In FIGS. 6 and 7, Stack 1 is the upstream stack while Stack 4 is the furthest downstream stack and Fixture 1 is the top fixture while Fixture 4 is the bottom fixture. These figures demonstrate the rapid and uniform heat up of parts at different locations in a treatment chamber according to this invention.

Figure 8:
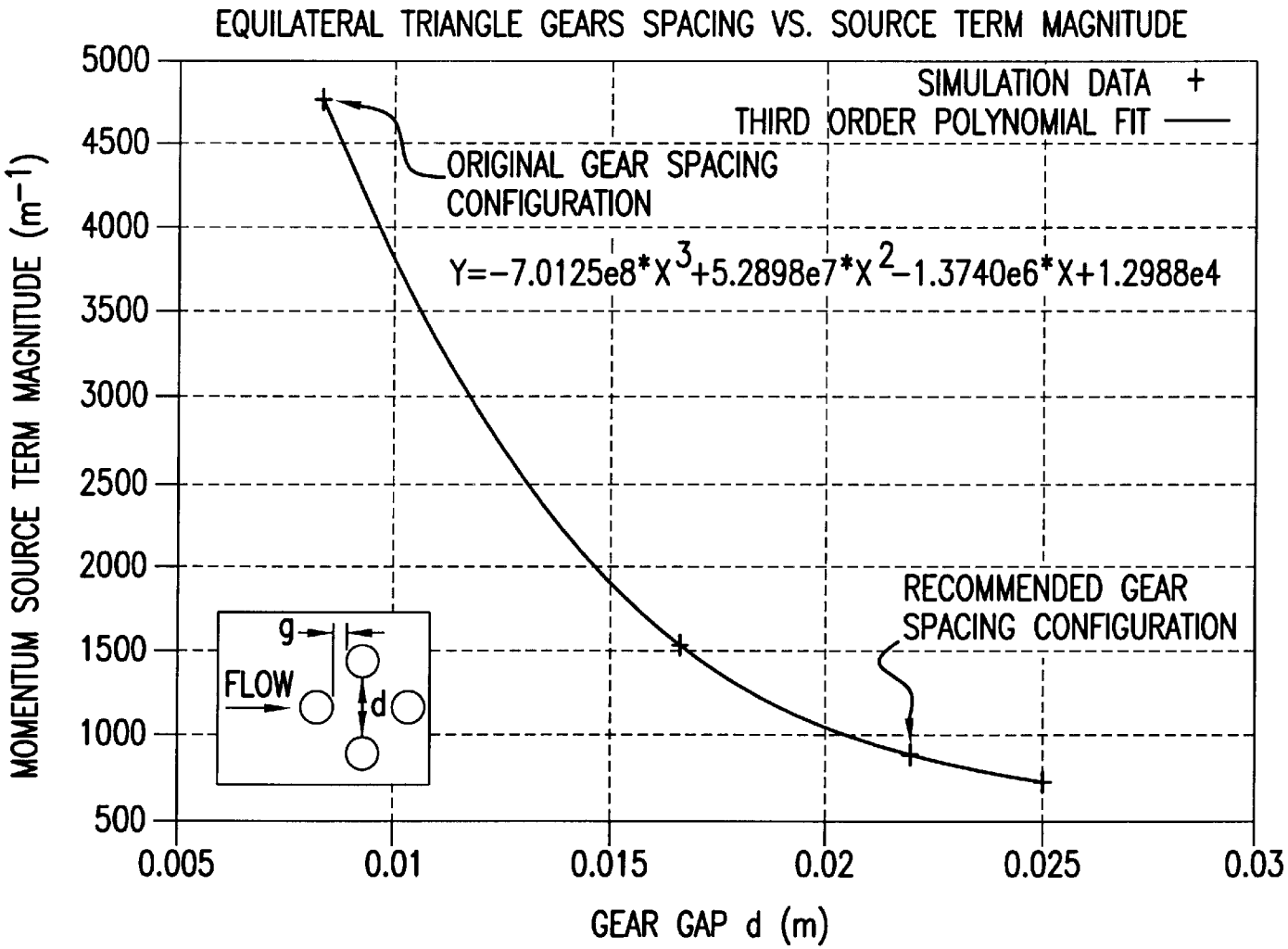
FIG. 8 shows part spacing as a function of source term magnitude.
Figure 9:
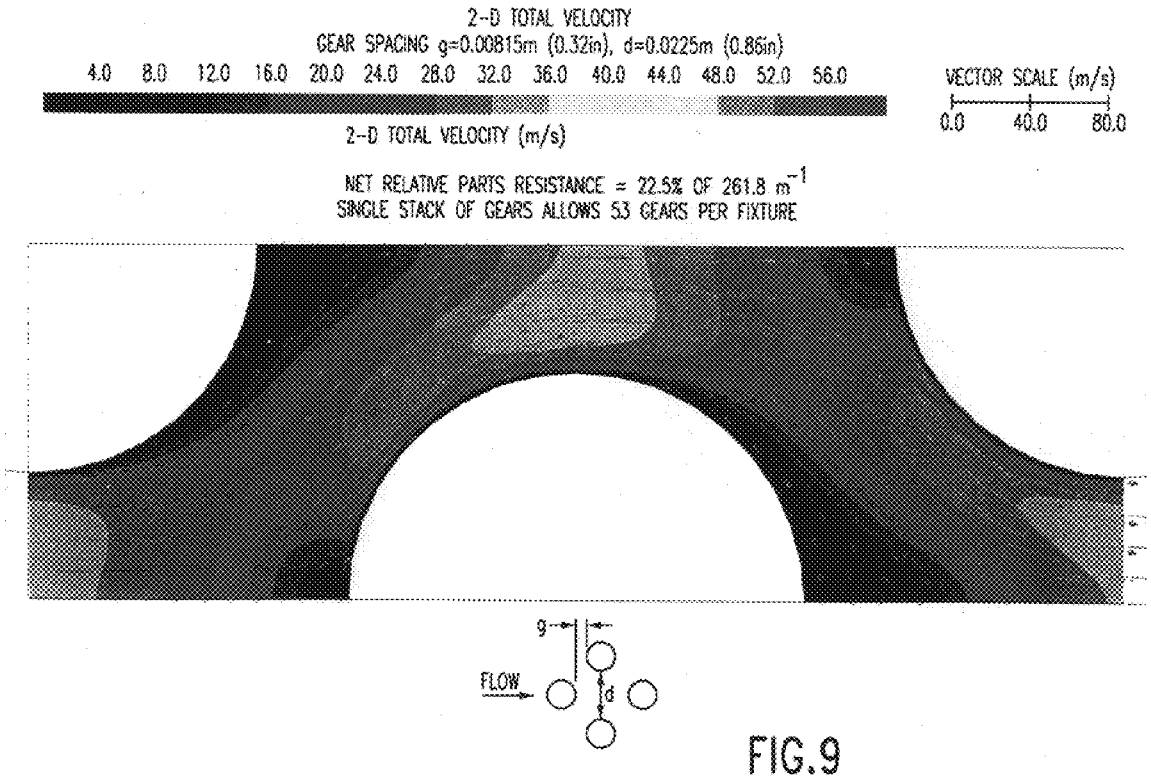
FIG. 9 shows results of a 2-D velocity study through a longitudinal section of parts at the indicated spacing.

To obtain optimal heating and processing performance, the clearance around and through the load being processed must have similar flow length (spacing) to the gaps between the load and the walls, hearth and roof. This makes the design of furnace fixtures important as the benefits of this invention will not be fully realized if the process gas flow can find low resistance flow passages around the load. FIGS. 8 and 9 show relationship of parts spacing to velocity of treatment fluid between stacks of components and how the spacing is used as a factor in determining the required loading for a given furnace configuration and fan capacity. FIG. 8 shows the effect of gear spacing from gear gap, (d) as shown in FIGS. 8 and 9, of 0.008 m to 0.025 m upon source term magnitude ($m^{-1}$) with recommended gear spacing of d=0.0225 m for the gears used. FIG. 9 shows the uniform flow results of a 2-D Total Velocity study with gears arranged as shown at the recommended gear spacing configuration of FIG. 8.

Flow studies have shown that end space configuration in the treatment chamber is not of critical importance to flow fields. Flexibility in the end spaces allows for changes in configuration of the treatment chamber in these areas to accommodate material handling and zone isolation (door) hardware.

In similar manner to described above, one skilled in the art can design a specific thermal treating apparatus configuration using a recirculation chamber and treatment gas bypass distribution, according to this invention, for specific treatments and capacities as required.

True convection thermal exchange between the treatment fluid and the articles being treated is achieved in this invention. According to this invention, convection thermal exchange is achieved in much smaller treatment chambers which have greatly reduced clearance between the articles being treated and the chamber walls, as compared with conventional heat treating furnaces, due to the thermal control means and blower means being located completely outside of the treatment chamber and due to the decreasing cross section along the length of the treatment chamber as a means of introduction of fresh treatment fluid along the length of the treatment chamber. These configurations reduce treatment chamber costs and increase overall thermal exchange efficiencies.

In one embodiment of this invention, the articles being treated are moved into the treatment chamber, moved through the treatment chamber, and removed from the treatment chamber by a pusher bar movable along the length of the treatment chamber and having a plurality of lugs radially extending from the pusher bar and spaced to be engageable with holding means for or with articles being treated upon rotation of the pusher bar. As seen in FIG. 2, pusher bar 44 has radially extending lugs 45 shown in full line position engaging holder 41 holding article trays 40 and rotatable in the direction of the arrows to the dashed line position disengaged from holder 41. With the lugs in the disengaged position, pusher bar 44 may be moved without movement of the articles or holders. Upon rotation of pusher bar 44 about 90 degrees, lugs 45 engage holders 41 or the articles being treated and moves them along the lengthwise axis of the treatment chamber a distance corresponding to movement of pusher bar 44. A plurality of lugs 45 may be spaced along pusher bar 44 at distances suitable to provide the desired spaced relation between adjacent holders 41 or articles being treated. Thereby, a single or multiple holders with stacks of trays may be moved through the treatment chamber, and, unlike presently used pusher bars, it is not necessary to push empty holders through the treatment chamber to unload the last of a line of loaded holders. Pusher bar 44 may be moved along its axis through a trough in the bottom of the treatment chamber. Pusher bar 44 may be moved by any suitable means, as will be readily apparent to one skilled in the art, and its movement may be controlled at any predetermined time sequence program by any suitable means, as will be apparent to one skilled in the art.

A thermal treatment system according to this invention may comprise a plurality of treatment chambers arranged end to end with each chamber isolated from the adjacent treatment chambers by insulating doors. Each treatment chamber has its own recirculation plenum with blower means, thermal control means and, if desired, chemical control means for provision of different thermal and chemical environments in each of the series of treatment chambers in a predetermined manner. Each treatment chamber may be a different length to accommodate a different number of articles being treated so as to provide different treatment times in each chamber using a single pusher bar for an in-line treatment system. Such a thermal treatment system of this invention provides substantially pure convection thermal exchange and even supply of desired chemical environment to each article being treated in each chamber. For example, in a carburizing process, a first heating treatment chamber may provide an oxidizing environment up to about 800° F. to deoil parts, then a second heating chamber may provide a carburizing non-oxidizing environment up to about 1350° F. for carburizing reaction with the surface of the articles, and a third heating chamber may provide a neutral environment up to about 1500° F. to prevent decarburization. Likewise, conditioning zones with controlled cooling of hot articles may be provided for controlled and even cooling prior to quick transfer to a quench bath. An unlimited number of combinations of treatment chambers to form treatment systems according to this invention for a wide variety of thermal and chemical treatment of articles will become apparent to one skilled in the art upon understanding of this invention.

Figure 10:
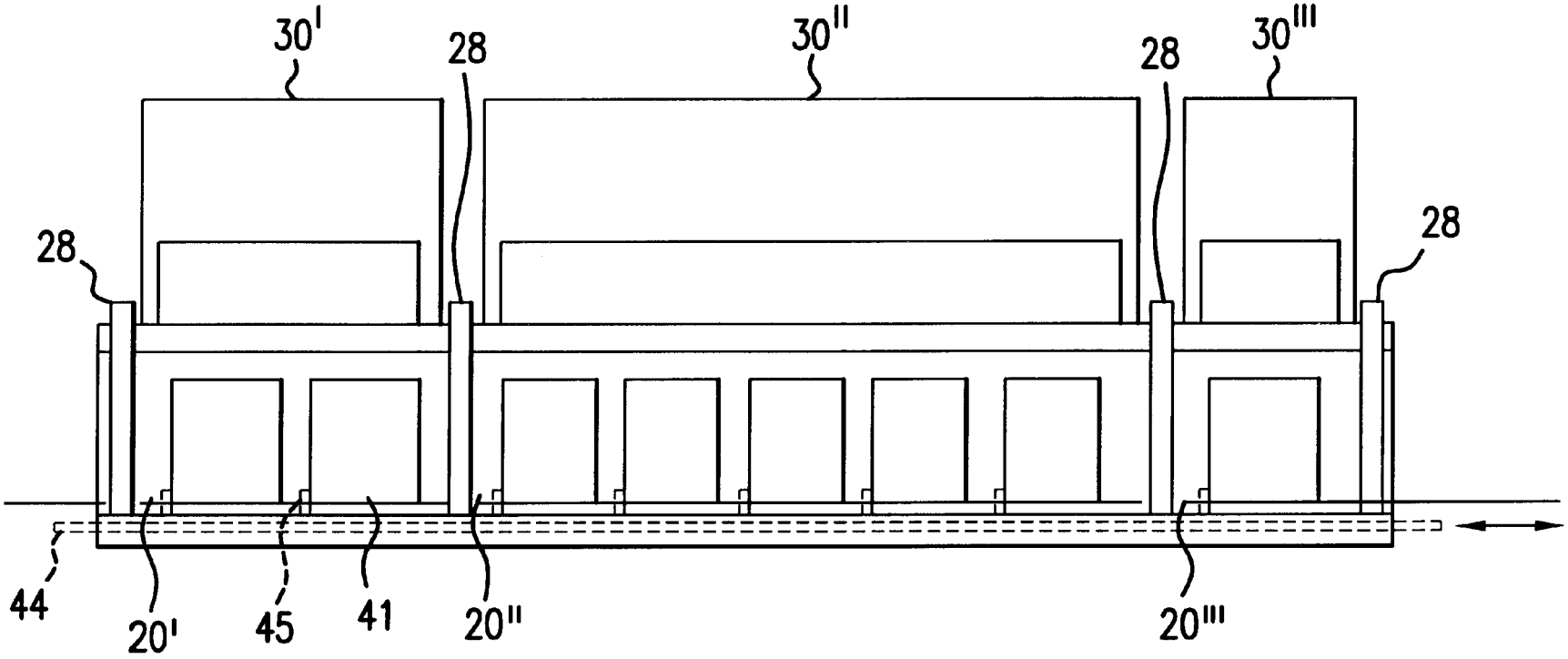
FIG. 10 is a schematic showing of a thermal treating system according to one embodiment of this invention having three separate treatment chambers

FIG. 10 schematically illustrates one thermal treatment system according to this invention wherein primed numerals have the same meanings as defined above with respect to FIGS. 1 and 2. Three treatment chambers 20', 20" and 20'" are arranged end to end with thermally insulated doors 28, which may be opened and closed by any suitable means readily apparent to one skilled in the art, allowing passage of articles and isolating the treatment chambers, respectively. Recirculation plenum 30' is associated with treatment chamber 20'. recirculation plenum 30" is associated with treatment chamber 20", and recirculation plenum 30'" is associated with treatment chamber 20'" and operable as described above, thereby providing different thermal and chemical treatments in each of the three treatment chambers, as desired. Pusher bar 44 extends the length of the treatment system and has radially extending lugs 45 spaced to engage each of the article holders 41, providing the desired spacing between the article holders for circulation of treatment fluid. Pusher bar movement to the right with radially extending lugs engaged with the article holders, as shown in FIG. 10, moves the article holders through the treatment system. Rotation of the pusher bar disengages radially extending lugs from the article holders and the pusher bar may be retracted to the left for loading of additional article holders. The treatment chambers may be of differing lengths to provide different treatment times in each of the treatment chambers, as required by the particular treatment system. It is readily apparent that two or any higher number of treatment chambers may be joined in similar series fashion to meet the requirements of particular treatment processes. When we refer to "series fashion" we mean to include a plurality of lines of treatment chambers with crossover chambers at their ends to provide more compact treatment systems. In such an arrangement, a separate pusher bar is used for each line of treatment chambers.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A thermal treating apparatus providing convection thermal transfer between a uniform flow of treatment fluid and articles being treated, comprising: an elongated treatment chamber; means for passing articles being treated in-line along the axis of said treatment chamber from a treatment upstream end portion to a treatment downstream end portion; a recirculation plenum exterior to said treatment chamber, said recirculation plenum having a recirculation plenum upstream end portion in fluid communication with said treatment downstream end portion of said treatment chamber and a recirculation plenum downstream end portion in fluid communication with said treatment chamber through distribution means providing decreasing cross sectional area from said treatment upstream end portion along at least a portion of the length of said treatment chamber to deliver treatment fluid at a plurality of locations along at least a portion of the length of said treatment chamber; a blower in said recirculation plenum to pass said treatment fluid through said treatment chamber and said recirculation fluid through said recirculation plenum; and thermal control means in said recirculation plenum to add or extract thermal energy to change said recirculation fluid to a desired thermal state for said treatment fluid.

2. A thermal treating apparatus according to claim 1 wherein said blower means passes said treatment fluid through said treatment chamber at a velocity of about 1600 to about 2400 feet per minute.

3. A thermal treating apparatus according to claim 1 wherein the entire amount of thermal energy provided to said treatment chamber passes through said recirculation plenum downstream end.

4. A thermal treating apparatus according to claim 1 wherein said thermal control means comprises heater means between said blower means and said recirculation plenum downstream end portion.

5. A thermal treating apparatus according to claim 4 wherein said heater means comprises a plurality of gas fired radiant tube heating elements.

6. A thermal treating apparatus according to claim 1 having chemical control means to change said recirculation fluid to a desired chemical state for said treatment fluid.

7. A thermal treating apparatus according to claim 6 wherein said chemical control means comprises a burner having variable fuel or oxidant control.

8. A thermal treating apparatus according to claim 6 wherein said chemical control means comprises injection means for injecting chemical into said recirculation fluid to change said recirculation fluid to a desired chemical state for said treatment fluid.

9. A thermal treating apparatus according to claim 1 wherein said thermal control means comprises heater means between said blower means and said recirculation plenum downstream end portion and further having chemical control means to change said recirculation fluid to a desired chemical state for said treatment fluid.

10. A thermal treating apparatus according to claim 1 wherein said distribution means comprises converging sidewalls or converging top and bottom walls of said treatment chamber to deliver treatment fluid at said plurality of locations.

11. A thermal treatment apparatus according to claim 10 wherein said distribution means comprises a sloping roof of said treatment chamber to deliver treatment fluid at said plurality of locations.

12. A thermal treating apparatus according to claim 1 wherein said distribution means comprises a plurality of bypass channels in opposite sidewalls to deliver treatment fluid at said plurality of locations.

13. A thermal treating apparatus according to claim 12 wherein said bypass channels are in staggered vertical arrangement in one of said opposite sidewalls with respect to the other of said opposite sidewalls.

14. A thermal treating apparatus according to claim 1 wherein said thermal control means comprises heater means between said blower and said recirculation plenum downstream end portion and further having chemical control means to change said recirculation fluid to a desired chemical state for said treatment fluid and said distribution means comprises converging sidewalls or converging top and bottom walls of said treatment chamber to deliver treatment fluid at said plurality of locations.

15. A thermal treating apparatus according to claim 14 wherein said distribution means comprises a sloping roof of said treatment chamber to deliver treatment fluid to said plurality of locations.

16. A thermal treating apparatus according to claim 14 wherein said distribution means comprises a plurality of bypass channels in opposite sidewalls to deliver treatment fluid at said plurality of locations.

17. A thermal treating process providing convection thermal transfer between a flow of treatment fluid and articles being treated, comprising; passing spent treatment fluid from the downstream end of an elongated treatment chamber into a recirculation chamber; passing said spent treatment fluid through a blower and in thermal exchange relation with a thermal exchange mechanism in said recirculation chamber to convert said spent treatment fluid into fresh treatment fluid; passing said fresh treatment fluid through distribution means providing decreasing cross sectional area of said treatment chamber from the treatment fluid upstream end along at least a portion of the length of said treatment chamber delivering fresh treatment fluid at a plurality of locations along at least a portion of the length of said treatment chamber; passing said treatment fluid over said articles being treated and into said downstream end of said treatment chamber.

18. A thermal treating process according to claim 17 further comprising passing said spent treatment fluid in fluid communication with a chemical control means to convert said spent treatment fluid into fresh treatment fluid within said recirculation chamber.

19. A thermal treating process according to claim 17 wherein said distribution means comprises converging sidewalls or converging top and bottom walls of said treatment chamber delivering treatment fluid at said plurality of locations.

20. A thermal treatment process according to claim 17 wherein said distribution means comprises a sloping roof of said treatment chamber delivering treatment fluid at said plurality of locations.

21. A thermal treating process according to claim 17 wherein said distribution means comprises a plurality of bypass channels in opposite sidewalls delivering treatment fluid at said plurality of locations.

* * * * *